US008071898B2

(12) United States Patent
Bennett et al.

(10) Patent No.: US 8,071,898 B2
(45) Date of Patent: Dec. 6, 2011

(54) SWITCHING DEVICE WITH A SWITCHING SHAFT FOR MOUNTING A ROTARY CONTACT LINK AND MULTIPOLE SWITCHING DEVICE ARRANGEMENT

(75) Inventors: Justin Bennett, Atlanta, GA (US); Wolfgang Erven, Amberg (DE)

(73) Assignee: Siemens Aktiengesellschaft, Munich (DE)

( * ) Notice: Subject to any disclaimer, the term of this patent is extended or adjusted under 35 U.S.C. 154(b) by 678 days.

(21) Appl. No.: 12/222,924

(22) Filed: Aug. 20, 2008

(65) Prior Publication Data

US 2009/0057112 A1 Mar. 5, 2009

(30) Foreign Application Priority Data

Aug. 21, 2007 (DE) ..... 10 2007 040 163

(51) Int. Cl.
*H01H 1/22* (2006.01)

(52) U.S. Cl. ..... 200/244; 218/31; 335/16

(58) Field of Classification Search ..... 200/243–247, 200/249, 250, 257, 273, 274, 400; 218/30–33, 218/146; 335/16, 147, 195
See application file for complete search history.

(56) References Cited

U.S. PATENT DOCUMENTS 5,310,971 A 5/1994 Vial et al.
6,114,641 A * 9/2000 Castonguay et al. ..... 218/32
6,310,307 B1 10/2001 Ciarcia
7,005,594 B2 * 2/2006 Kim ..... 218/22
7,148,775 B2 * 12/2006 Park ..... 218/22

FOREIGN PATENT DOCUMENTS

| | | |
|---|---|---|
| DE | 69304374 | 2/1997 |
| DE | 19933919 | 1/2001 |
| DE | 10150550 | 12/2002 |
| DE | 10013160 | 7/2006 |
| EP | 0560697 | 9/1993 |
| EP | 1137038 | 9/2001 |
| EP | 1196936 | 4/2002 |
| EP | 1302960 | 4/2003 |

OTHER PUBLICATIONS

Office Action dated Jan. 19, 2011 in corresponding German Patent Application No. 10 2007 040 163.0.

* cited by examiner

*Primary Examiner* — Renee S Luebke
*Assistant Examiner* — Marina Fishman
(74) *Attorney, Agent, or Firm* — Harness, Dickey & Pierce, PLC

(57) ABSTRACT

A switching device, in particular a circuit breaker, is disclosed including a switching shaft for mounting a rotary contact link. According to at least one embodiment of the invention, the rotary contact link has at least one groove-shaped longitudinal cutout, arranged within and along the transversely running cutout in relation to the switching shaft. Two grooves, which are arranged radially opposite one another, with in each case a bend or arcuate profile are provided in the cutout of the switching shaft, the respective two ends of the grooves being positioned radially further outward than the respective central region thereof. In each case one groove is connected to the at least one groove-shaped longitudinal cutout via a transverse bolt guided there between. At least one prestressed spring element is provided which pushes the respective transverse bolt radially outward.

16 Claims, 5 Drawing Sheets

SWITCHING DEVICE WITH A SWITCHING SHAFT FOR MOUNTING A ROTARY CONTACT LINK AND MULTIPOLE SWITCHING DEVICE ARRANGEMENT

PRIORITY STATEMENT

The present application hereby claims priority under 35 U.S.C. §119 on German patent application number DE 10 2007 040 163.0 filed Aug. 21, 2007, the entire contents of which is hereby incorporated herein by reference.

FIELD

Embodiments of the invention generally relate to a switching device, in particular a circuit breaker. For example, embodiments may relate to a switching device including a switching shaft for mounting a rotary contact link with two switching contacts and a pair of fixed contacts, which pair interacts with the rotary contact link, for connection to in each case one current path. The fixed contacts and the current paths may be designed, in at least one embodiment, in such a way that the rotary contact link is rotated from a closed position in the direction of an open position in the event of an overcurrent or a short circuit. The switching shaft may include, in at least one embodiment, a transversely running cutout for mounting the rotary contact link, which protrudes on both sides out of the switching shaft. The rotary contact link may be connected, via at least one spring element, in at least one embodiment, to the switching shaft for applying a contact force in the closed position and for the rotary contact link to remain in the open position.

Embodiments of the invention furthermore may generally relate to a multipole switching device arrangement with at least two such switching devices with at least one coupling bolt for connecting, in a manner fixed against rotation, the respective switching shafts to one another.

BACKGROUND

With switching devices, in particular low-voltage switching devices, the current paths switch between an electrical supply device and loads and therefore their operating currents. This means that, by way of current paths being opened and closed by the switching device, the connected loads can safely be switched on and off.

The translation DE 693 04 374 T2 of the European patent EP 0 560 697 B1 has disclosed a low-voltage circuit breaker in an insulating housing, which includes a rotary contact link, a pair of fixed contacts, which pair interacts with the mentioned contact link, power supply conductors for feeding the mentioned fixed contacts, a switching shaft with a transversely running cutout for mounting, with play, the contact link, which protrudes on both sides out of the switching shaft, and at least one pair of tension springs, which are arranged between the switching shaft and the contact link. The fixed contacts are designed in such a way that they generate electrodynamic forces repelling the contact link in the direction of a repelling open position if a short-circuit current is flowing through them. The tension springs serve the purpose of ensuring a contact pressure, which is exerted by the contact link on the fixed contacts, in the closed position of the circuit breaker and at the same time of making a rotation of the contact link possible under the effect of the mentioned electrodynamic forces in the direction of the repelling open position.

The mentioned springs are arranged symmetrically on both sides of the axis of rotation of the contact link and each have an end mounted on the contact link. An opposite end of the mentioned springs is mounted on a rod, which is arranged in a latching notch of the switching shaft in such a way that it is displaceable in sliding fashion. The mentioned contact link has a pair of control cams, which are arranged symmetrically with respect to the mentioned axis and are each designed in such a way that they interact with one of the rods in the end section of the repulsive excursion of the contact link in order to brake the movement of the contact link.

An electrical low-voltage switching device, such as a circuit breaker or a contactor, for example, has, for the purpose of switching the current paths, one or more so-called main contacts, which can be controlled by one or else more control magnets or electromagnetic drives. In principle, the main contacts in this case include a movable contact link and fixed contact pieces, to which the load and the supply device are connected. In order to close or open the main contacts, a corresponding closing or opening signal is emitted to the electromagnetic drive, whereupon said contacts act with their armature on the movable contact links in such a way that the contact links perform a relative movement in relation to the fixed contact pieces and either close or open the current path to be switched. In the context of the invention made, only switching devices with a rotary contact link are taken into consideration.

SUMMARY

In at least one embodiment of the invention, a switching device with a rotary contact link is specified, which is mounted in the switching shaft alternatively in a sprung manner.

In at least one embodiment of the invention, a suitable multipole switching device arrangement is specified, with at least two such switching devices.

According to at least one embodiment of the invention, the rotary contact link has at least one groove-shaped longitudinal cutout, which is arranged within and along the transversely running cutout in relation to the switching shaft. Two grooves, which are arranged radially opposite one another, with in each case a bent or arcuate profile are provided in the cutout of the switching shaft, the respective two ends of said grooves being positioned radially further outward than the respective central region thereof. "Radial" refers to directions toward the axis of rotation of the switching shaft and away from it. In each case one groove being connected to the at least one groove-shaped longitudinal cutout via a transverse bolt guided therebetween. At least one prestressed spring element being provided which pushes the respective transverse bolt radially outward.

The particular advantage is the fact that the opening response of the rotary contact link can be set precisely by means of the groove guide according to at least one embodiment of the invention. The groove guide makes it possible for the rotary contact link to be rotated back reliably and quickly into the closed position again when the central region between the respective two groove ends is not reached. If, however, the rotary contact link, or the transverse bolts guiding the rotary contact link, reaches the central region between the respective two groove ends, immediate, quick and irrevocable rotation of the rotary contact link into the open position takes place. The transverse bolt typically has a circular cross section, at least in the region of the grooves and in the region in which it passes through the groove-shaped longitudinal cutout in the rotary contact link.

In accordance with one embodiment, the at least one groove-shaped longitudinal cutout and the two grooves have an identical groove width. As a result, more precise guidance of the rotary contact link along the grooves is possible.

In accordance with a further embodiment, the two grooves are arranged in point-symmetrical fashion with respect to the axis of rotation of the switching shaft. As a result, more precise guidance of the rotary contact link about the axis of rotation is possible.

In accordance with a particularly advantageous embodiment, the two ends of the respective grooves are arranged on a radially outer region of the switching shaft. In each case one bend or an elbow is formed between the respective two ends. The two grooves run straight between the respective bend and the respective two ends. As a result of the bend, a particularly precise switchover response between the closed position and the open position of the switching device is possible. The straight groove profile between the respective bend and the respective two ends makes it possible for the transverse bolts to be moved in the grooves with little resistance.

In particular, the rotary contact link is mounted in the transversely running cutout of the switching shaft by way of the two transverse bolts in such a way that the rotary contact link is snapped back tangentially into the closed position or into the open position once the respective bends have been reached. "Tangentially" denotes directions about the axis of rotation of the switching shaft.

In accordance with a further embodiment, the two transverse bolts in the closed position of the switching device are guided toward the first end of the respective groove. The two transverse bolts in the open position are guided toward the second end of the respective groove. In this case, the groove length from the respective first end to the bend is approximately twice to four times as long as the groove length from the respective second end to the bend. The L shape of the two grooves formed thereby allows for a high compensation path for a corresponding rotary movement of the rotary contact link preferably in the event of an overcurrent. The shorter limb, which is aligned more in the longitudinal direction of the groove-shaped longitudinal cutout in the rotary contact link, ensures that the rotary contact link reliably remains in the open position. Preferably, the obtuse angle formed between the two L limbs is in a region of 100° to 140°, in particular is approximately 120°.

In accordance with an example embodiment, the switching shaft includes two axially opposite switching shaft segments, which are formed in mirror-inverted fashion and in whose axial center the transversely running cutout for mounting the rotary contact link is arranged. "Axially" denotes directions parallel to the axis of rotation of the switching shaft. The at least one groove-shaped longitudinal cutout in the rotary contact link is axially continuous, with the result that the two transverse bolts can be passed through for the purpose of guiding the rotary contact link. In comparison with the single-part solution, i.e. with only one switching shaft segment, even safer guidance of the interposed rotary contact link is possible. At the same time, the at least one spring element and the transverse bolts are protected more effectively against external environmental influences, such as dust, switching gases, residues from shutdown operations, for example.

In accordance with one embodiment, only a (single) groove-shaped longitudinal cutout is provided in the rotary contact link. Furthermore, only a (single) spring element is provided which pushes the two transverse bolts radially outward.

In particular, the spring element is arranged in the groove-shaped longitudinal cutout in the rotary contact link. In this case, the spring element pushes the two transverse bolts radially outward. This simplifies: the design of the switching device further.

As an alternative or in addition, the at least one spring element is arranged in the region of the respective transversely running cutout between the respective switching shaft segment and the rotary contact link. The at least one spring element in each case pushes the two transverse bolts radially outward. In particular, a spring element is arranged in each of the two transversely running cutouts. The particular advantage of this arrangement is the fact that more space is possible for the installation of in particular the two spring elements in comparison with the introduction of the springs in the groove-shaped longitudinal cutout in the rotary contact link. As a result, a higher spring force can be realized.

The at least one spring element is preferably a cylinder spring. It can be accommodated, for the purpose of applying the spring force, in two pressure sleeves, which introduce the spring force into the respective transverse bolt. The spring force can alternatively be introduced by the spring element via its two ends directly into the transverse bolts.

As an alternative or in addition, the at least one spring element can be a leaf spring. It can be designed to have a single or double clasp. Preferably, the leaf spring has corresponding shaped-out portions for introducing the spring force into the two transverse bolts.

At least one embodiment is directed to a multipole switching device arrangement, which has at least two, in particular three, switching devices according to the invention. The switching device arrangement has at least one coupling bolt for connecting, in a manner fixed against rotation, the respective switching shafts to one another.

BRIEF DESCRIPTION OF THE DRAWINGS

The invention and advantageous embodiments of the invention will be described in more detail below with reference to the following figures, in which.

DETAILED DESCRIPTION OF THE EXAMPLE EMBODIMENTS

Figure 1:
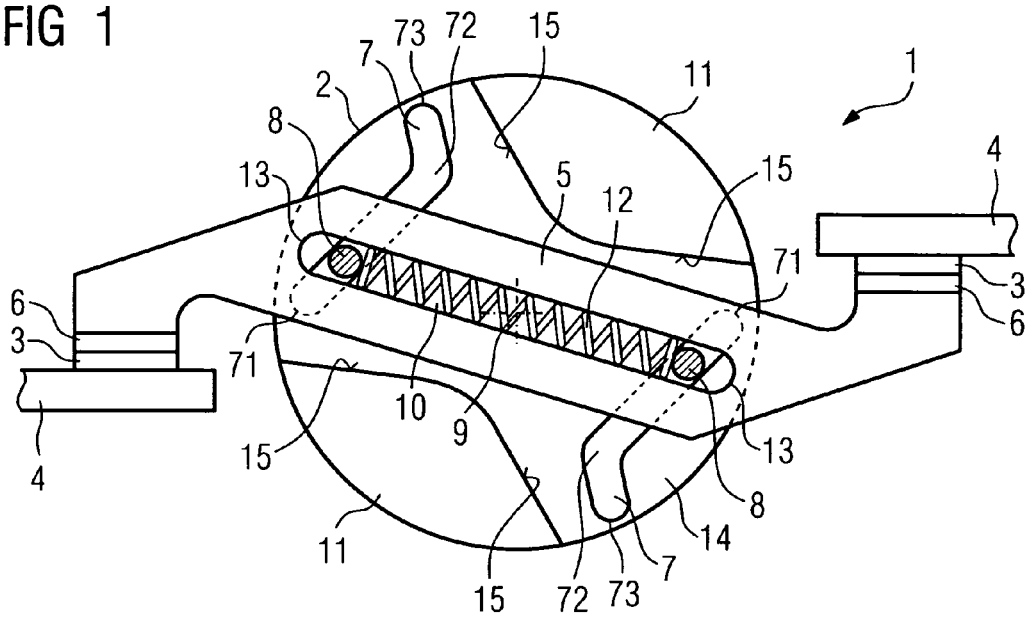
FIG. 1 shows an exemplary switching device with a switching shaft, illustrated in section, with a rotary contact link mounted therein, in a closed position, in accordance with a first embodiment of the invention.

Various example embodiments will now be described more fully with reference to the accompanying drawings in which only some example embodiments are shown. Specific structural and functional details disclosed herein are merely representative for purposes of describing example embodiments. The present invention, however, may be embodied in many alternate forms and should not be construed as limited to only the example embodiments set forth herein.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

FIG. 1 shows an example switching device 1 with a switching shaft 2, illustrated in section, with a rotary contact link 5 mounted therein in a closed position in accordance with a first embodiment of the invention.

The switching device 1 shown has a switching shaft 2 for mounting a rotary contact link 5 with two switching contacts 6 and a pair of fixed contacts 3, which pair interacts with the rotary contact link 5, for connection to in each case one current path 4. The contacts 3, 6 are arranged in such a way that they are tangentially opposite one another in relation to the axis of rotation 9 of the switching shaft 2. In other words, the flat contacts 3, 6 substantially lie in a plane running through the axis of rotation 9. The fixed contacts 3 and the current paths 4 are designed in such a way that the rotary contact link 5 is rotated from a closed position in the direction of the open position in the event of an overcurrent or a short circuit. In this case, electrodynamic forces which are caused by mutually repelling currents flowing through in the current paths 4 and in the rotary contact link 5 are critical. The electrodynamic forces bring about a torque, which moves the rotary contact link 4 in the direction of the open position. The switching shaft 2 furthermore has a transversely running cutout 14 for mounting, with play, the rotary contact link 5, which protrudes on both sides out of the switching shaft 2. The transversely running cutout 14 is formed by two radially opposite stops 11 for the rotary contact link 5. They extend in the axial direction with respect to the rotary contact link 4. They each have an arcuate stop face 15, which faces the central region of the rotary contact link 5. In addition, the rotary contact link 5 is connected, via a spring element 12 in the form of a cylinder spring, to the switching shaft 2 for applying a contact force in the closed position and for the rotary contact link 5 to remain in the open position.

According to an embodiment of the invention, the rotary contact link 5 shown has at least one groove-shaped longitudinal cutout 10, which is arranged within and along the transversely running cutout 14 in relation to the switching shaft 2. In the example in FIG. 1, only a (single) groove-shaped longitudinal cutout 10 is provided in the rotary contact link 5. The reference symbol 13 denotes the ends or the groove stops of the longitudinal cutout. Alternatively, two longitudinal cutouts, which are arranged one behind the other in the longitudinal extent of the rotary contact link 5, can also be provided. In addition, two grooves 7, which are arranged opposite one another radially and in particular point-symmetrically with respect to the axis of rotation 9 of the switching shaft 2, each having a bent or arcuate profile, are provided in the cutout 14 of the switching shaft 2. In the example in FIG. 1, the two grooves 7 have an L-shaped or limb-shaped profile, the respective two ends 71, 73 thereof being positioned radially further outwards than the respective central region 72 thereof or than the respective bend 72 shown thereof. In addition, the two ends 71, 73 of the respective grooves 7 are arranged on a radially outer region of the switching shaft 2. The grooves 7 have a straight profile between the bend 72 and the respective two ends 71, 73.

Furthermore, in the example in FIG. 1, each groove 7 is connected to the groove-shaped longitudinal cutout 10 via a transverse bolt 8 guided therebetween, the latter being pushed radially outward via only one prestressed spring element 12 in the form of a cylinder spring. In the example in FIG. 1, even only one spring element 12 is arranged in the groove-shaped longitudinal cutout 10 in the rotary contact link 5.

The groove-shaped longitudinal cutout 10 in the rotary contact link 5 has an identical groove width to the grooves 7, with the result that the transverse bolts 8 can precisely follow the respective groove 7 in the event of the onset of a rotary movement. At the same time, the cylinder spring 12 is compressed as the rotary movement increases by way of the transverse bolts 8, which migrate inward from the view of the groove-shaped longitudinal cutout 10. In order to fix the rotary contact link 5 axially, the switching shaft 2 can have a covering disk (not shown). This covering disk can be fixed on the stops 11, for example by way of two screws.

Figure 2:
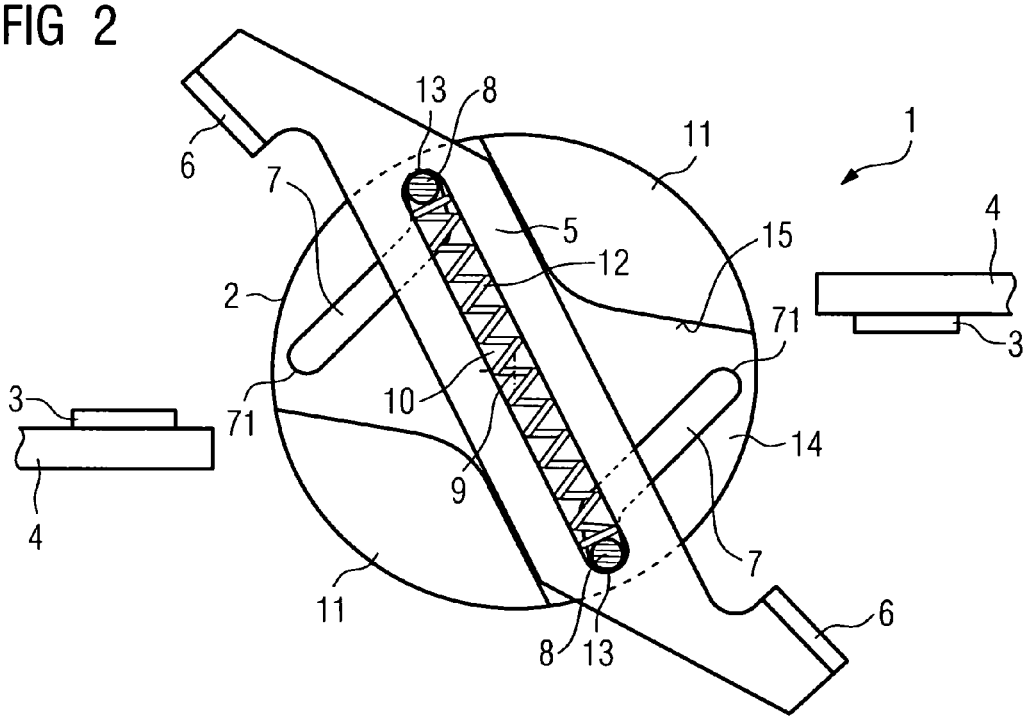
FIG. 2 shows the switching device shown in FIG. 1 in an open position.

FIG. 2 shows the switching device 1 shown in FIG. 1 in an open position. In accordance with an embodiment of the invention, the rotary contact link 5 is mounted in the transversely running cutout 14 of the switching shaft 2 by means of the two transverse bolts 8 in such a way that the rotary contact link 5 is snapped back tangentially into the closed position or into the open position once the respective bends 72 have been reached. As shown in FIG. 2, the rotary contact link 5 is now snapped back from the closed position shown in FIG. 1 into the open position now shown. While the two transverse bolts 8 in the closed position of the switching device 1 are still guided toward the first end 71 of the respective groove 7, the two transverse bolts 8 in the open position shown are guided toward the second end 73 of the respective groove 7. The transverse bolts 8, which are pushed by way of the spring force toward the respective second groove end 73, in the process ensure that the rotary contact link 5 remains in the open position. In order, for safety reasons, to make it possible for reconnection to take place only in the case of a high resetting torque, it is advantageous if the groove length from the respective first end 71 to the bend 72 is approximately two to four times as long as the groove-length from the respective second end 73 to the bend 72.

Figure 3:
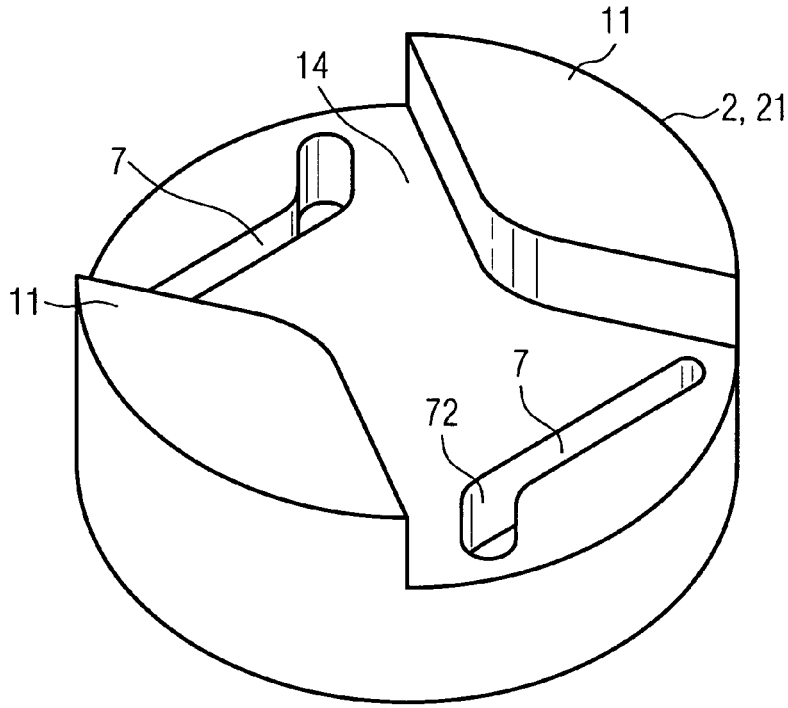
FIG. 3 shows, by way of example, a switching shaft segment in a perspective view.

FIG. 3 shows, by way of example, a switching shaft segment 21 in a perspective view. Preferably, the switching shaft 2 comprises two such axially opposite switching shaft segments 21 which are formed in mirror-inverted fashion. The transversely running cutout 14 for mounting the rotary contact link 5 (not shown in any greater detail) is arranged in the axial center of said switching shaft segments. In this case, the groove-shaped longitudinal cutout 20 in the rotary contact link 5 is then axially continuous, in contrast to the first embodiment shown in FIG. 1 and FIG. 2, with the result that the two transverse bolts 8 for guiding the rotary contact link 5 can be passed through.

Figure 4:
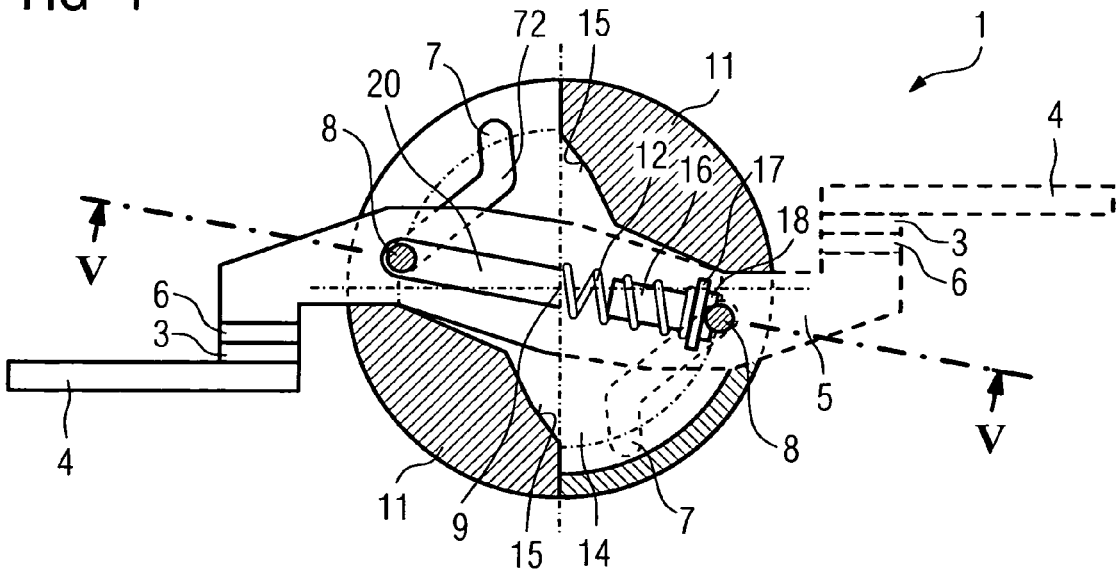
FIG. 4 shows an example switching device with a switching shaft, shown in a combined sectional illustration, in a closed position in accordance with a second embodiment of the invention.

FIG. 4 shows an exemplary switching device 1 with a switching shaft 2, which is shown in a combined sectional illustration, in a closed position in accordance with a second embodiment of the invention. The left-hand part of FIG. 4 shows an axial section through the rotary contact link 5. The right-hand part shows an axial section through one of two spring elements 12 provided.

By way of example, a spring element 12 in the form of a cylinder spring 12 is arranged in the region of the respective transversely running cutout 14 between the respective switching shaft segment 21 and the rotary contact link 5. The spring element 12 in the process pushes the two transverse bolts 8 radially outward. In order to avoid bending or deflection of the cylinder spring 12 during compression, a spring sleeve 16 is inserted at the two ends of the cylinder spring 12. This spring sleeve 16 has in each case one spring plate 17, on which the cylinder spring rests. An adjoining pressure piece 18, which is matched to the shape of the transverse bolts 8, finally transfers the spring force to the respective transverse bolt 8.

Figure 5:
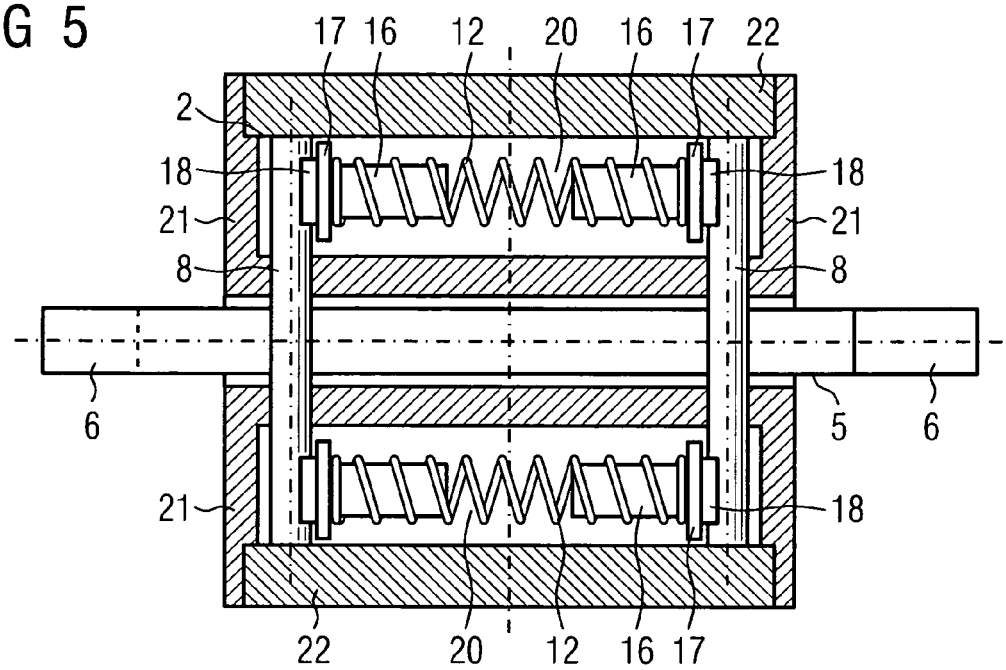
FIG. 5 shows a sectional illustration of the switching device shown in FIG. 4 along the section line V-V illustrated in FIG. 4, FIGS. 6 and 7 show example spring elements in the form of a cylinder spring and a leaf spring.

FIG. 5 shows a sectional illustration of the switching device 1 shown in FIG. 4 along the section line V-V illustrated in FIG. 4. This illustration shows, in particular, the two transversely running cutouts 14, in which the two cylinder springs 12 are accommodated.

Figure 6:
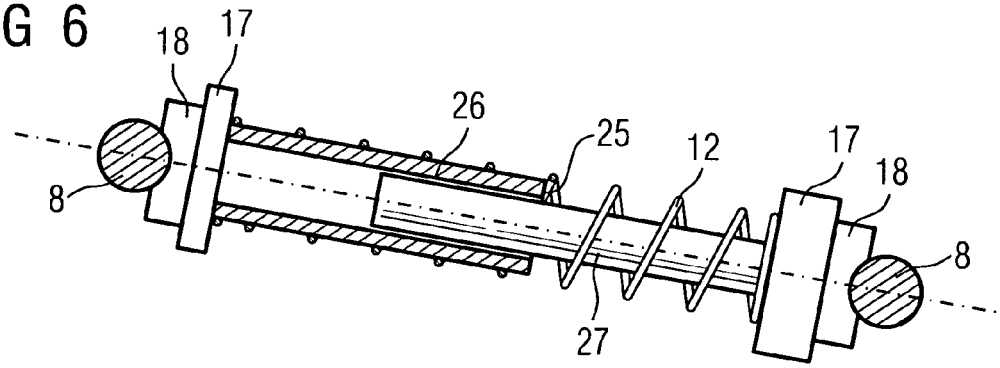

FIG. 6 shows exemplary spring elements 12 in the form of a cylinder spring 12. For improved longitudinal guidance of the cylinder spring 12, the latter is clamped in in a telescope 25. The telescope 25 has a telescope sleeve 26 and a telescope bar 27 which is capable of being displaced relative thereto.

Figure 7:
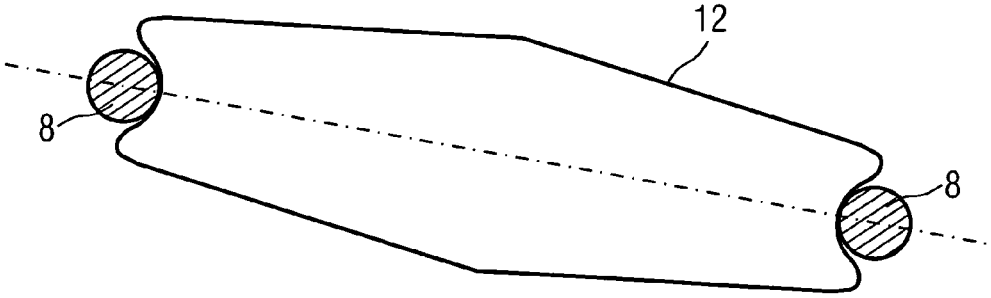

FIG. 7 shows exemplary spring elements 12 in the form of a leaf spring. It has corresponding shaped-out portions (not designated), which are introduced onto the outer contour of the two transverse bolts 8 for the purpose of holding and guiding the leaf springs 12.

Figure 8:
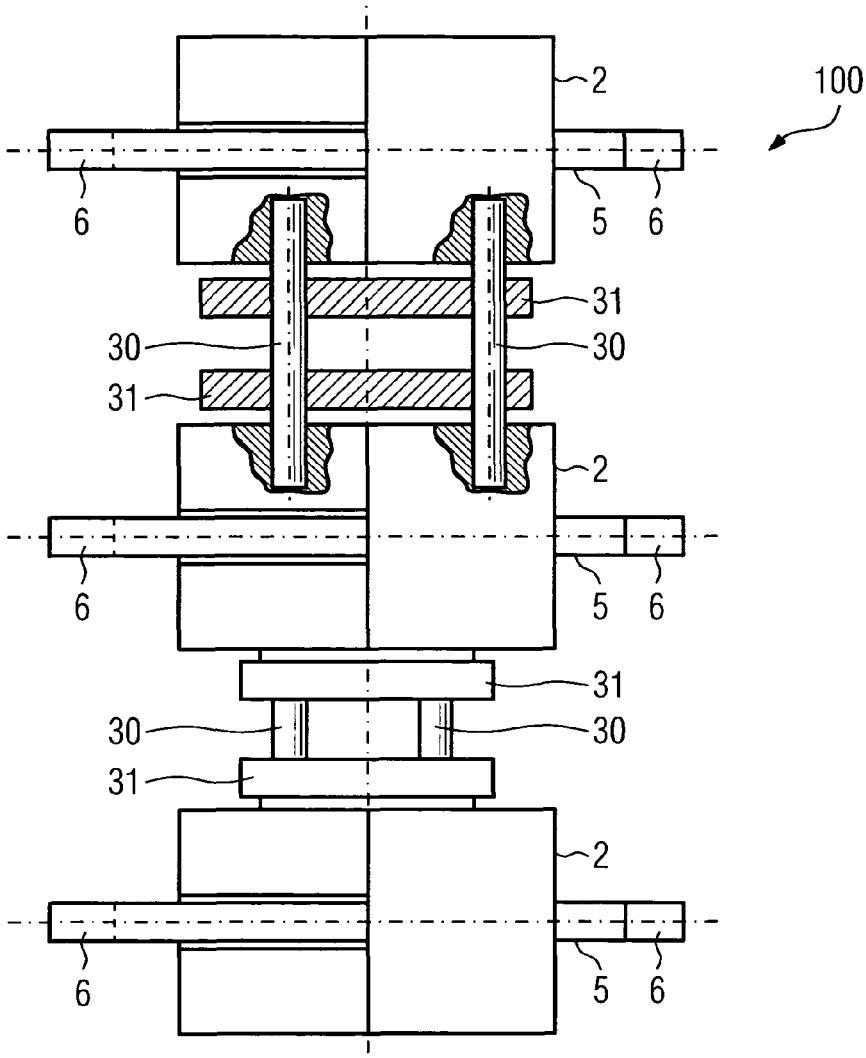
FIG. 8 shows an example of a multipole switching device arrangement with three switching devices in accordance with the invention.

FIG. 8 shows an example of a multipole switching device arrangement 100 with three switching devices 1 in accordance with an embodiment of the invention. The switching devices 1 are in each case connected to one another via two coupling bolts 30 for connecting, in a manner fixed against rotation, the respective switching shafts 2 to one another. In the case of only one coupling bolt 30, this is to be arranged so as to be aligned with the axis of rotation 9 of the switching shaft 2. The reference symbol 31 denotes a coupling plate for accommodating the coupling bolt 30. The coupling bolt 30 can be designed to be conical at their two ends. As a result, improved centering of the respective switching shafts 1 with one another is possible.

Figure 9:
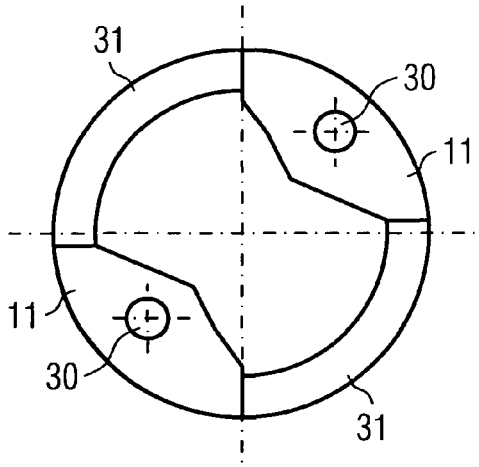
FIG. 9 shows a plan view of a coupling plate of the switching device arrangement shown in FIG. 8.

FIG. 9 shows a plan view of a coupling disk 31 of the switching device arrangement 100 shown in FIG. 8.

Figure 10:
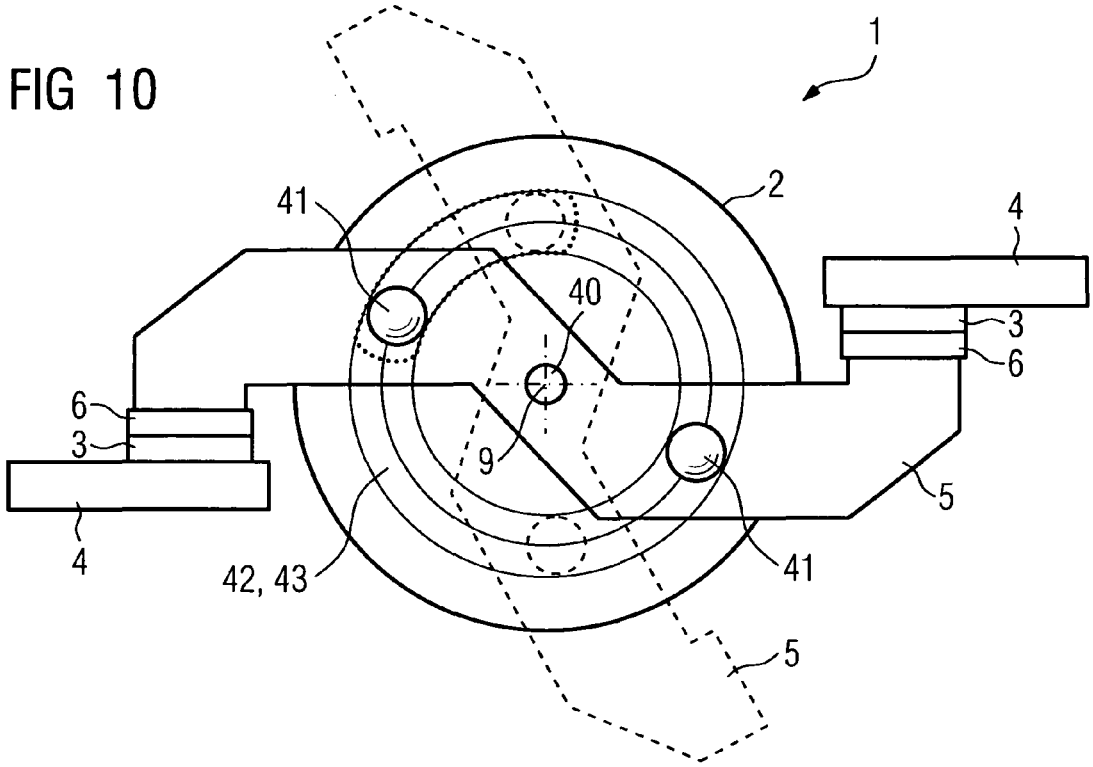
FIG. 10 shows, by way of example, a switching device with a rotary contact link mounted in a switching shaft with ball-latching which is independent of an embodiment of the present invention.

FIG. 10 shows, by way of example, a switching device 1 with a rotary contact link 5 mounted in a switching shaft 2 with ball-latching, which is independent of an embodiment of the present invention.

The switching device 1 shown is in particular a circuit breaker. The switching device 1 has a switching shaft 2 for mounting (with play) a rotary contact link 5 with two switching contacts 6 and a pair of fixed contacts 3, which pair interacts with the rotary contact link 5, for connection to in each case one current path 4. The fixed contacts 3 and the current paths 4 are designed in such a way that the rotary contact link 5 is rotated from a closed position in the direction of an open position in the event of an overcurrent or a short circuit. The switching shaft 2 includes two axially opposite switching shaft segments 21, in whose axial center a transversely running cutout for mounting the rotary contact link 5, which protrudes on both sides out of the switching shaft 2, is arranged.

In particular, in each case two guide grooves 42, 43, which run substantially circularly, are opposite one another and adjoin the rotary contact link 5, are provided in the two switching segment shafts 21. The rotary contact link 5 has two radially opposite apertures 48, which are arranged between the guide grooves 42, 43, in each case one ball 41 being introduced in the aperture 48. In addition, the guide grooves 42, 43 are shaped out in terms of their groove depth in such a way that, in the event of a rotary movement of the rotary contact link 5 from the closed position in the direction of the open position, the balls 41 which are carried along by the apertures 48 follow a radially and axially running oblique plane. This can be seen in the example in FIG. 11 and in particular in FIG. 12. The two balls 48 latch at the end of the respective guide groove 42, 43 in a latching pocket 46 shaped out there in such a way that the rotary contact link 5 remains in the open position formed by the latching.

It is particularly advantageous that no separate rotary stops 11 are required, as shown, for example, in FIG. 3. The rotary contact link 5 is moved from the closed position into the open position by the electrodynamic forces and torques, in a similar way to that described in FIG. 1, in the event of an overcurrent and/or in the event of a short circuit. Preferably, the switching device 1 has a torsion spring arranged coaxially with respect to the axis of rotation 9 of the switching shaft 2 or a tension or compression spring, which acts, for example, on a lever arm of the rotary contact link 5.

Alternatively, in each case (only) one guide groove, which runs substantially circularly, are opposite one another and adjoin the rotary contact link 5, can be provided in the two switching segment shafts 21. In this case, the rotary contact link 5 is mounted rotatably, and therefore without any play, at a fulcrum 40, such as in a rotary bolt, for example. The rotary contact link 5 has an aperture 48, which is arranged between the guide grooves 42, 43 and in which a ball 41 is introduced. The guide grooves 42, 43 are shaped out with respect to their groove depth in such a way that, in the event of a rotary movement of the rotary contact link 5 from the closed position in the direction of the open position, the ball 41 carried along through the aperture 48, follows a radially and axially running, oblique plane. At the end of the guide groove 42, 43, the ball 48 can latch in a latching pocket 47 shaped out there in such a way that the rotary contact link 5 remains in the open position formed by the latching.

Figure 11:
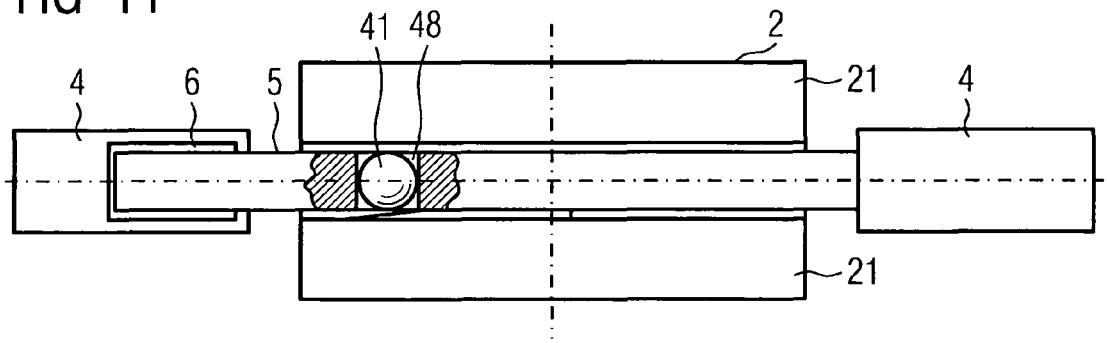
FIGS. 11 and 12 show a section through the switching device shown in FIG. 10 in a closed position and in an almost open position.
Figure 12:
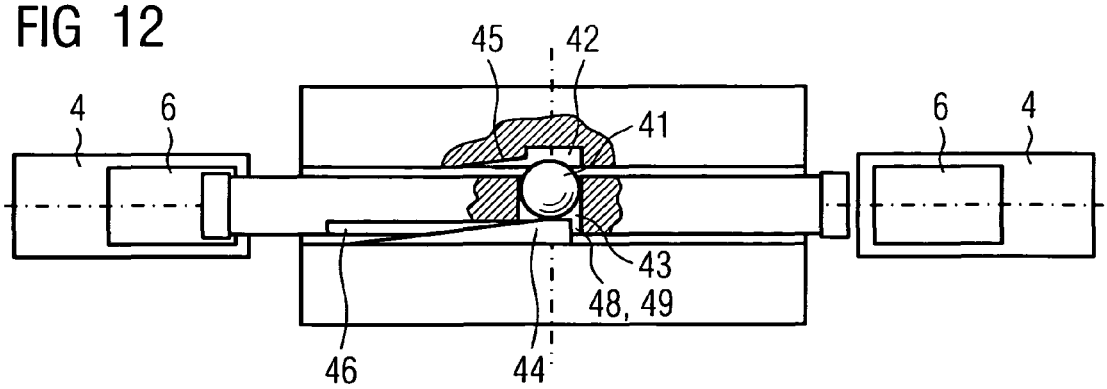

FIG. 11 and FIG. 12 show a section through the switching device 1 shown in FIG. 10 in a closed position and in a virtually open position. The oblique plane or bevel 44, 45 which is introduced into the respective guide grooves 42, 43 can clearly be seen. The reference symbol 46 denotes a cut-free portion in order to enable free rotation of the rotary contact link 5. FIG. 12 shows how the carried-along ball 41 is moved into the latching pocket 47, but the final open position has not yet been reached. This position is reached when the aperture 48 moves the ball 41 shown further toward the right, with the result that the ball 41 can fall into the latching pocket 47 so as to latch behind the end of the oblique plane 49.

Furthermore, a latching spring element (not illustrated in any more detail) can be arranged in the latching pocket 47 and pushes the ball 41 axially into the latching pocket 47. The depth and the shape of the latching pocket 47 are preferably designed in such a way that the rotary contact link 5 can be moved into the closed position again, for example by way of a jolt.

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer program and computer program product. For example, of the aforementioned methods may be embodied in the form of a system or device, including, but not limited to, any of the structure for performing the methodology illustrated in the drawings.

Even further, any of the aforementioned methods may be embodied in the form of a program. The program may be stored on a computer readable media and is adapted to perform any one of the aforementioned methods when run on a computer device (a device including a processor). Thus, the storage medium or computer readable medium, is adapted to store information and is adapted to interact with a data processing facility or computer device to perform the method of any of the above mentioned embodiments.

The storage medium may be a built-in medium installed inside a computer device main body or a removable medium arranged so that it can be separated from the computer device main body. Examples of the built-in medium include, but are not limited to, rewriteable non-volatile memories, such as ROMs and flash memories, and hard disks. Examples of the removable medium include, but are not limited to, optical storage media such as CD-ROMs and DVDS; magneto-optical storage media, such as MOs; magnetism storage media, including but not limited to floppy disks (trademark), cassette tapes, and removable hard disks; media with a built-in rewriteable non-volatile memory, including but not limited to memory cards; and media with a built-in ROM, including but not limited to ROM cassettes; etc. Furthermore, various information regarding stored images, for example, property information, may be stored in any other form, or it may be provided in other ways.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

LIST OF REFERENCE SYMBOLS

1 Switching device, circuit breaker
2 Switching shaft, drum, carrier plate
3 Fixed contact
4 Current path, current conductor, phase
5 Rotary contact link
6 Switching contact
7 Groove
8 Transverse bolts
9 Axis of rotation
10, 20 Longitudinal cutout, slot
11 Stop, rotary stop
12 Spring element, cylinder spring, leaf spring
13 Ends of transversely running cutout
14 Transversely running cutout
15 Stop face
16 Spring sleeve
17 Pressure piece
18 Spring plate
21 Switching shaft segment
22 Cover plate
25 Telescope
26 Telescope sleeve
27 Telescope bar
30 Coupling bolt
31 Coupling plate
40 Fulcrum, rotary bolt
41 Ball, inhibiting ball

42, 43 Guide groove
44, 45 Bevel, oblique plane
46 Cut-free portion
47 Latching pocket
48 Aperture, guide opening
49 End of oblique plane
71, 73 Ends of guide groove
72 Bend, elbow
100 Multipole switching device arrangement

What is claimed is:

1. A switching device, comprising:

a switching shaft to mount a rotary contact link with two switching contacts and a pair of fixed contacts, the pair of fixed contacts to interact with the rotary contact link for connection to, in each case, one current path, the fixed contacts and the current paths being designed in such a way that the rotary contact link is rotatable from a closed position in the direction of an open position in the event of an overcurrent or a short circuit, the switching shaft including a transversely running cutout to mount the rotary contact link, which protrudes on both sides out of the switching shaft, the rotary contact link being connected, via at least one spring element, to the switching shaft to apply a contact force in the closed position and for the rotary contact link to remain in the open position, the rotary contact link including at least one groove-shaped longitudinal cutout, arranged within and along the transversely running cutout in relation to the switching shaft, two grooves, arranged radially opposite one another, with, in each case, a bend or arcuate profile provided in the cutout of the switching shaft, the respective two ends of said grooves being positioned radially further outward than the respective central region thereof, in each case one groove being connected to the at least one groove-shaped longitudinal cutout via a transverse bolt guided therebetween, and the at least one spring element being provided which pushes the respective transverse bolt radially outward.

2. The switching device as claimed in claim 1, wherein the at least one groove-shaped longitudinal cutout and the two grooves include an identical groove width.

3. The switching device as claimed in claim 1, wherein the two grooves are arranged in point-symmetrical fashion with respect to the axis of rotation of the switching shaft.

4. The switching device as claimed in claim 1, wherein the two ends of the respective grooves are arranged on a radially outer region of the switching shaft, wherein, in each case, one bend is formed between the respective two ends, and wherein the two grooves run straight between the respective bend and the respective two ends.

5. The switching device as claimed in claim 4, wherein the rotary contact link is mounted in the transversely running cutout of the switching shaft by way of the two transverse bolts in such a way that the rotary contact link is snapped back tangentially into the closed position or into the open position once the respective bends have been reached.

6. The switching device as claimed in claim 5, wherein the two transverse bolts in the closed position of the switching device are guided toward a first end of the respective two ends of the respective groove, the two transverse bolts in the open position are guided toward a second end of the respective two ends of the respective groove, and wherein the groove length from the respective first end to the bend is approximately twice to four times as long as the groove length from the respective second end to the bend.

7. The switching device as claimed in claimed in claim 1, wherein the switching shaft comprises two axially opposite switching shaft segments, formed inversely to each other and in whose axial center the transversely running cutout for mounting the rotary contact link is arranged, and the at least one groove-shaped longitudinal cutout in the rotary contact link is axially continuous, resulting in the two transverse bolts being passable through for the purpose of guiding the rotary contact link.

8. The switching device as claimed in claim 1, wherein only one groove-shaped longitudinal cutout is provided in the rotary contact link, and wherein only one spring element is provided which pushes the two transverse bolts radially outward.

9. The switching device as claimed in claim 8, wherein the spring element is arranged in the groove-shaped longitudinal cutout in the rotary contact link and pushes the two transverse bolts radially outward.

10. The switching device as claimed in claim 7, wherein the at least one spring element is arranged in the region of the respective transversely running cutout between the respective switching shaft segment and the rotary contact link, the at least one spring element in each case pushing the two transverse bolts radially outward.

11. The switching device as claimed in claim 1, wherein the at least one spring element is at least one of a coil spring and a leaf spring.

12. A multipole switching device arrangement with at least two switching devices as claimed in claim 1 with at least one coupling bolt for the connection, in a manner fixed against rotation, of the respective switching shafts to one another.

13. The switching device as claimed in 1, wherein the switching device is a circuit breaker.

14. The switching device as claimed in claim 2, wherein the two grooves are arranged in point-symmetrical fashion with respect to the axis of rotation of the switching shaft.

15. The switching device as claimed in claim 8, wherein the at least one spring element is arranged in the region of the respective transversely running cutout between the respective switching shaft segment and the rotary contact link, the at least one spring element in each case pushing the two transverse bolts radially outward.

16. The switching device as claimed in claim 9, wherein the at least one spring element is arranged in the region of the respective transversely running cutout between the respective switching shaft segment and the rotary contact link, the at least one spring element in each case pushing the two transverse bolts radially outward.

* * * * *